US009566782B1

(12) United States Patent
Sasaki et al.

(10) Patent No.: US 9,566,782 B1
(45) Date of Patent: Feb. 14, 2017

(54) IMAGE FORMING APPARATUS, IMAGE FORMING METHOD AND COMPUTER READABLE MEDIUM

(71) Applicant: FUJI XEROX CO., LTD., Tokyo (JP)

(72) Inventors: Hirotake Sasaki, Kanagawa (JP); Shinji Seto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/012,988

(22) Filed: Feb. 2, 2016

(30) Foreign Application Priority Data

Aug. 6, 2015 (JP) ..... 2015-155872

(51) Int. Cl.
*B41J 2/045* (2006.01)
*B41J 2/21* (2006.01)

(52) U.S. Cl.
CPC ..... *B41J 2/04508* (2013.01); *B41J 2/04586* (2013.01); *B41J 2/2132* (2013.01)

(58) Field of Classification Search
CPC . B41J 2/04508; B41J 2/04573; B41J 2/04503; B41J 11/008; B41J 13/0009; B41J 2/2132
See application file for complete search history.

(56) References Cited

U.S. PATENT DOCUMENTS

2014/0168312 A1* 6/2014 Mizes ..... B41J 2/01 347/17

FOREIGN PATENT DOCUMENTS

| | | |
|---|---|---|
| JP | 2007-022095 | 2/2007 |
| JP | 2012-236311 | 12/2012 |
| JP | 2015-012357 | 1/2015 |

OTHER PUBLICATIONS

Abstract and machine translation of JP 2007-022095.
Abstract and machine translation of JP 2015-012357.
Abstract and machine translation of JP 2012-236311.

* cited by examiner

*Primary Examiner* — Thinh H Nguyen
(74) *Attorney, Agent, or Firm* — Fildes & Outland, P.C.

(57) ABSTRACT

An image forming apparatus includes: a feeding unit that feeds a recording medium; an ejection unit that ejects droplets onto the recording medium fed by the feeding unit; a derivation unit that derives a fluctuation amount range of droplet speed of each droplet commencing with a second droplet relative to droplet speed of a first droplet as a range satisfying set image quality when continuous ejection of droplets are performed by the ejection unit so that the droplets are ejected continuously in different positions on the recording medium in a feeding direction of the recording medium within a range higher than an upper limit value of predetermined image formation speed but lower than limit image formation speed; and a control unit that performs control on the feeding unit and the ejection unit so as to form an image on the recording medium at image formation speed as defined herein.

14 Claims, 13 Drawing Sheets

| | | NUMBER OF CONTINUOUSLY EJECTED DROPLETS | | | | | |
|---|---|---|---|---|---|---|---|
| | | 1 | 2 | 3 | 4 | 5 | ··· |
| DROPLET NUMBER | 1 | $V_{11}$ | $V_{21}$ | $V_{31}$ | | | |
| | 2 | | $V_{22}$ | $V_{32}$ | | | |
| | 3 | | | $V_{33}$ | | | |
| | 4 | | | | | | |
| | 5 | | | | | | |
| | ⋮ | | | | | | |

IMAGE FORMING APPARATUS, IMAGE FORMING METHOD AND COMPUTER READABLE MEDIUM

CROSS-REFERENCE TO RELATED APPLICATIONS

This application is based on and claims priority under 35 USC 119 from Japanese Patent Application No. 2015-155872 filed on Aug. 6, 2015.

BACKGROUND

Technical Field

The present invention relates to an image forming apparatus, an image forming method and a computer readable medium storing a program causing a computer to function as a derivation unit and a control unit of the image forming apparatus.

SUMMARY

According to an aspect of the invention, there is provided an image forming apparatus comprising: a feeding unit which feeds a recording medium; an ejection unit which ejects droplets onto the recording medium fed by the feeding unit; a derivation unit which derives a fluctuation amount range of droplet speed of each droplet commencing with a second droplet relative to droplet speed of a first droplet as a range satisfying set image quality when continuous ejection of droplets are performed by the ejection unit so that the droplets are ejected continuously in different positions on the recording medium in a feeding direction of the recording medium within a range higher than an upper limit value of predetermined image formation speed but lower than limit image formation speed; and a control unit which performs control on the feeding unit and the election unit so as to form an image on the recording medium at image formation speed within a range determined in accordance with the range derived by the derivation unit.

BRIEF DESCRIPTION OF THE DRAWINGS

Exemplary embodiment of the present invention will be described in detail based on the following figures, wherein.

REFERENCE SIGNS LIST

Figure 1:
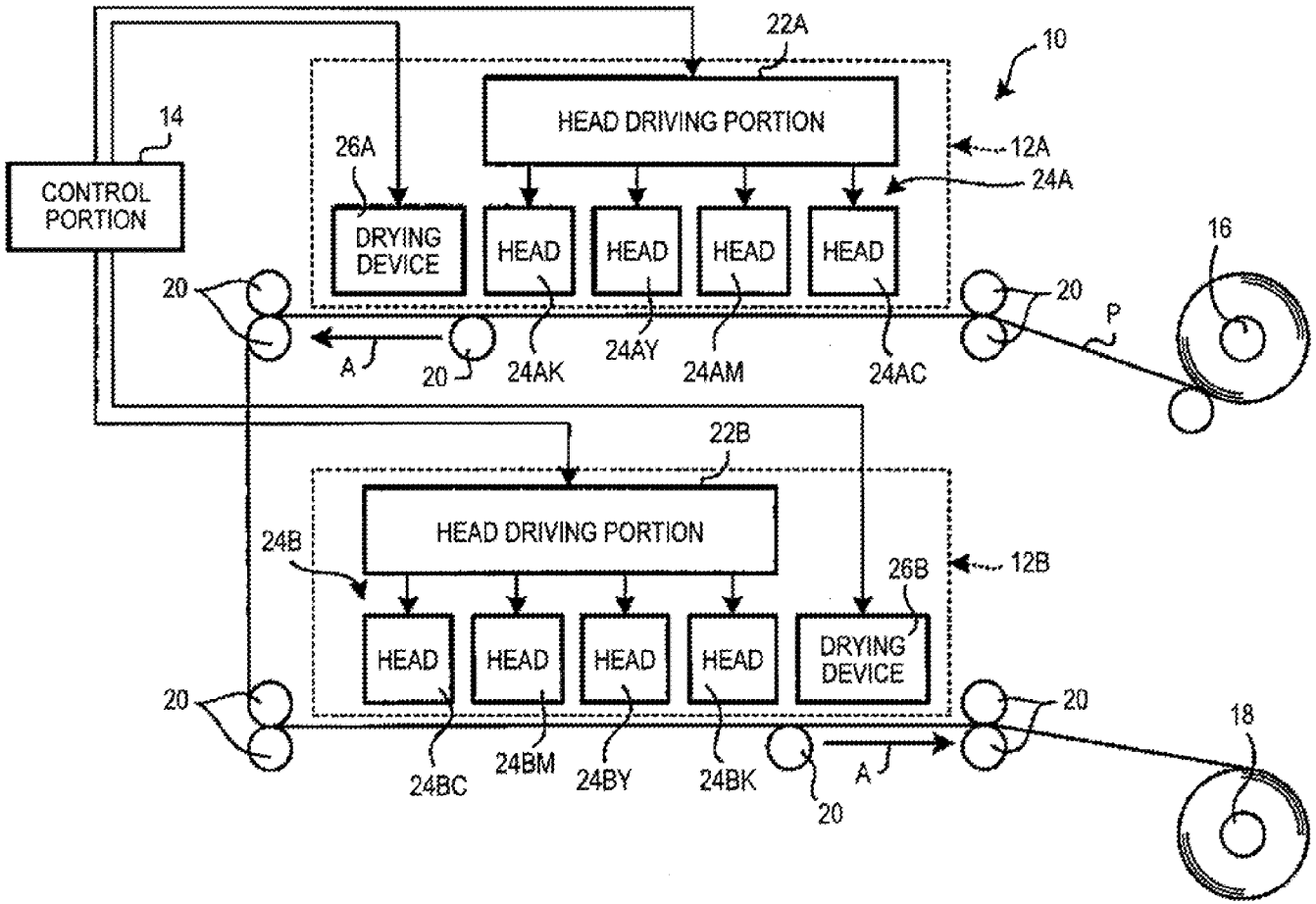
FIG. 1 is a schematic configuration diagram showing the configuration of a main portion of a droplet ejection type recording apparatus according to an exemplary embodiment of the invention.

10 droplet ejection type recording apparatus
14 control portion
22A, 22B head driving portion
24AC, 24AM, 24AY, 24AK, 24BC, 24BM, 24BY, 24BK head
50 CPU
70 display control portion
72 acceptance portion
74 derivation portion
76 image formation control portion

DETAILED DESCRIPTION

A mode for carrying out the invention will be described below in detail with reference to the drawings.

First, the configuration of a droplet ejection type recording apparatus 10 as an example of an image forming apparatus according to an exemplary embodiment of the invention will be described with reference to FIG. 1. Incidentally, a cyan color is expressed as C; a magenta color, M; a yellow color, Y; and a black color, K. In addition, when respective constituent components and tonner images (images) have to be distinguished from one another based on the respective colors, color codes (C, M, Y, K) corresponding to the respective colors will be added to the ends of signs in the description. On the other hand, when the respective constituent components and the toner images do not have to be distinguished from one another based on the respective colors but can be mentioned generically, the color codes added to the ends of the signs will be omitted in the description.

For example, the droplet ejection type recording apparatus 10 is provided with two image forming portions 12A and 12B, a control portion 14, a paper supplying roll 16, a discharging roll 18, and a plurality of feeding rollers 20. The two image forming portions 12A and 12B can form images on opposite surfaces of a paper sheet P in one feeding.

In addition, the image forming portion 12A is provided with a head driving portion 22A, heads 24A and a drying device 26A. Similarly, the image forming portion 12B is provided with a head driving portion 22B, heads 24B and a drying device 26B. Incidentally, there is a case where indication of a suffix "A" and a suffix "B" at the ends of signs may be omitted below when it is not necessary to distinguish between the image forming portion 12A and the image forming portion 12B and between common members included in the image forming portion 12A and the image forming portion 12B.

The control portion 14 drives a feeding motor 62 (see FIG. 3) to control rotation of the feeding rollers 20 which are, for example, connected to the feeding motor 62 through a mechanism of gears etc. A long paper sheet P as an example of a recording medium is wound on the paper supplying roll 16 so that the paper sheet P can be fed in a direction of an arrow A in FIG. 1 in accordance with rotation of the feeding rollers 20. Incidentally, the direction for feeding the paper sheet P will be hereinafter referred to as "feeding direction" simply. In addition, the feeding rollers 20 are an example of a feeding unit according to the invention.

Upon acceptance of image information, the control portion 14 controls the image forming portion 12A based on color information for each pixel of an image contained in the image information. Thus, the image corresponding to the image information is formed on one image formation surface of the paper sheet P.

Specifically, the control portion 14 issues an instruction of droplet ejection timing to the head driving portion 22A to thereby control the head driving portion 22A. The head driving portion 22A drives heads 24A connected to the head driving portion 22A in accordance with the instruction of the droplet ejection timing from the control portion 14 to thereby eject droplets from the heads 24A. Thus, an image corresponding to the image information is formed on one image formation surface of the paper sheet P fed in accordance with the control of the control portion 14.

Incidentally, the color information for each pixel of the image included in the image information includes information expressing the color of the pixel uniquely. The exemplary embodiment will be described on the assumption that the color information for each pixel of the image is represented by concentration of each of the colors C, M, Y and K by way of example. However, another representation method for expressing the colors of the image uniquely may be used.

The heads 24A include four heads 24AC, 24AM, 24AY and 24AK corresponding to the four colors C, M, Y, and K to eject droplets of the corresponding colors from the respective heads 24A. Incidentally, the head driving portions 22 and the heads 24 are an example of an ejection unit according to the invention.

The control portion 14 controls the drying device 26A to dry the image formed on the paper sheet P to thereby fix the image to the paper sheet P.

Then, the paper sheet P is fed to a position opposing to the image forming portion 12B in accordance with rotation of the feeding rollers 20. On this occasion, the paper sheet P is turned inside out and fed so that the other image formation surface different from the image formation surface on which the image has been formed by the image forming portion 12A can face the image forming portion 12B.

The control portion 14 also executes, on the image forming portion 12B, similar control to the aforementioned control on the image forming portion 12A. Thus, an image corresponding to the image information can be formed on the other image formation surface of the paper sheet P.

The heads 24B include four heads 24BC, 24BM, 24BY and 24BK corresponding to the four colors, i.e. the C color, the M color, the Y color and the K color, respectively. Droplets of the corresponding colors are ejected from the respective heads 24B.

The control portion 14 controls the drying device 26B to dry the image formed on the paper sheet P to thereby fix the image to the paper sheet P.

Then, the paper sheet P is fed to the position of the discharging roll 18 and wound around the discharging roll 18 in accordance with rotation of the feeding rollers 20.

Incidentally, although the configuration of the apparatus for forming images on opposite surfaces of a paper sheet P in one feeding starting at the paper supplying roll 16 and ending at the discharging roll 18 has been described as the droplet ejection type recording apparatus 10 according to the exemplary embodiment, the configuration of the apparatus may be provided for forming an image on a single surface of a paper sheet P.

In addition, water-based ink is used as droplets in he droplet ejection type recording apparatus 10 according to the exemplary embodiment. However, the droplets are not limited thereto. For example, oil-based ink serving as ink containing a solvent which can be evaporated, ultraviolet-curable type ink, etc. may be used as the droplets.

Figure 2A:
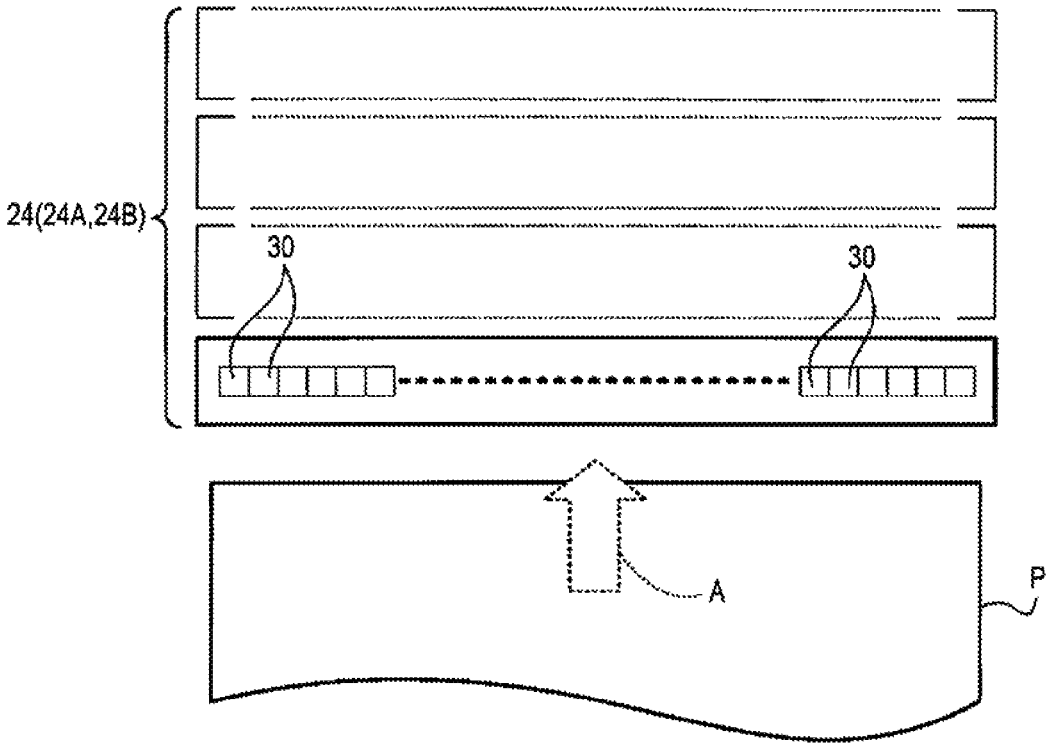
FIGS. 2A and 2B are views showing the schematic configuration of a head according to the exemplary embodiment, FIG. 2A being a plan view, FIG. 2B being a sectional view showing an internal structure of each droplet electing element in the head.

Next, the configuration of each head 24 according to the exemplary embodiment will be described with reference to FIGS. 2A and 2B. As show in FIG. 2A, the head 24 has a plurality of droplet ejecting members 30 arranged in a longitudinal direction of the head. Incidentally, the longitudinal direction of the head is a direction intersecting with a feeding direction (a direction of an arrow A in FIG. 2A), and may be hereinafter referred to as main scanning direction. In addition, the feeding direction may be hereinafter referred to as sub-scanning direction.

The layout of the droplet ejecting members 30 is not limited to a single array line in the main scanning direction. In some dot pitch (resolution), a plurality of array lines of droplet ejecting members 30 provided in the sub-scanning direction may be arrayed two-dimensionally in accordance with predetermined rules so that ejection timing in each array line can be controlled in accordance with the array line pitch and feeding speed of the paper sheet P.

Figure 2B:
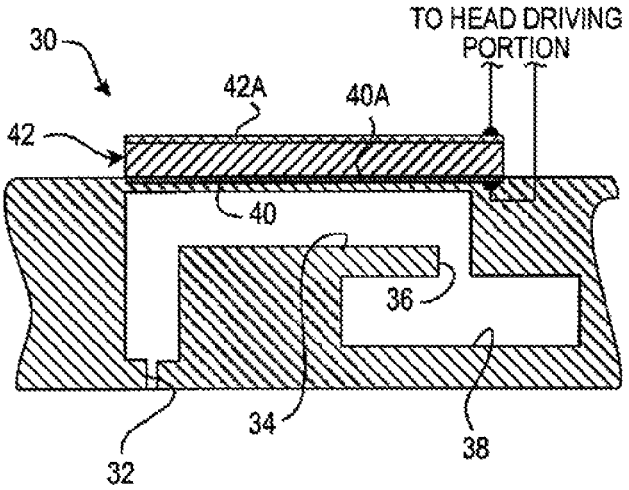

As shown in FIG. 2B, the droplet ejecting members 30 are provided with nozzles 32 and pressure chambers 34 corresponding to the nozzles 32 respectively. A supply port 36 is provided in each of the pressure chambers 34. The pressure chambers 34 are connected. to a common passage (common passage 38) through the supply ports 36.

The common passage 38 has a role of receiving supply of ink liquid from an ink supply tank (not shown) and distributing the received supply of the ink liquid to the respective pressure chambers 34. The ink supply tank serves as an ink liquid supply source.

A diaphragm 40 is attached to an upper surface of a ceiling portion of the pressure chamber 34 in each droplet ejecting member 30. In addition, a piezoelectric element 42 is attached to the side of an upper surface of the diaphragm 40. The diaphragm 40 is provided with a common electrode 40A. The piezoelectric element 42 is provided with an individual electrode 42A. When a voltage is selectively applied between one of the individual electrodes 42A of the piezoelectric elements 42 and the common electrode 40A, the selected piezoelectric element 42 is deformed so that a droplet can be ejected from the corresponding nozzle 32 and new ink liquids can be supplied from the common passage 38 into the pressure chamber 34.

Each of the head driving portions 22 (22A and 22B) is controlled by the control portion 14 based on the image information to generate a driving signal for applying a voltage to each of the individual electrodes 42A of the piezoelectric elements 42 independently.

Next, the configuration of a main portion of an electric system of the droplet ejection type recording apparatus 10 according to the exemplary embodiment will be described with reference to FIG. 3.

Figure 3:
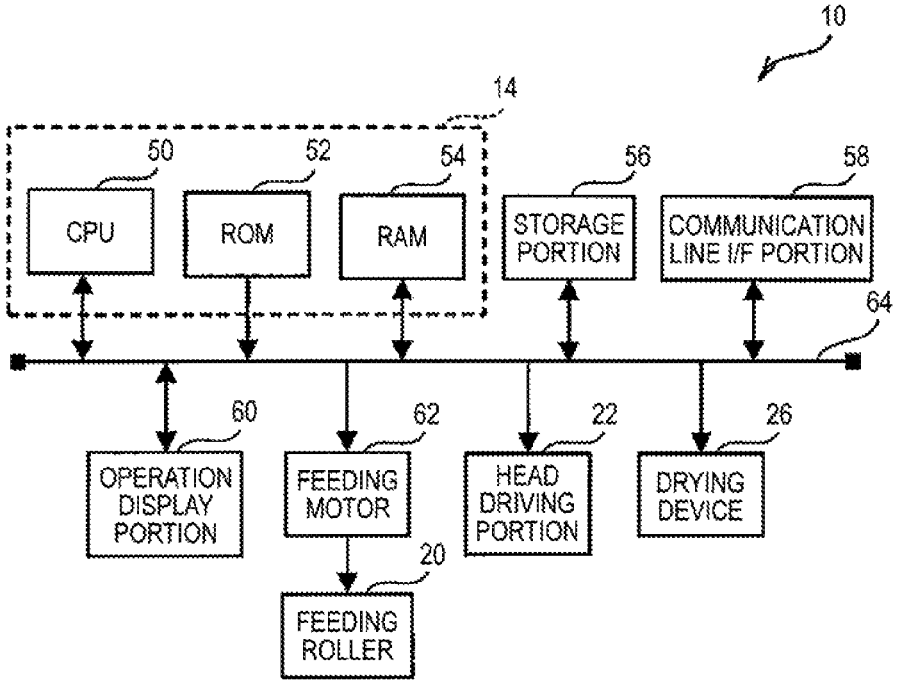
FIG. 3 is a block diagram showing the configuration of a main portion of an electric system of the droplet ejection type recording apparatus according to the exemplary embodiment.

As shown in FIG. 3, the control portion 14 according to the exemplary embodiment is provided with a CPU (Central Processing Unit) 50, and an ROM (Read Only Memory) 52. The CPU 50 takes in charge of an overall operation of the droplet ejection type recording apparatus 10. Various programs, various parameters, etc. are stored in the ROM 52 in advance. In addition, the control portion 14 is also provided with an RAM (Random Access Memory) 54. The RAM 54 is used as a work area etc. when the various programs are executed by the CPU 50.

In addition, the droplet ejection type recording apparatus 10 is provided with a non-volatile storage portion 56 such as a flash memory, and a communication line I/F (interface) portion 58. The communication line I/F portion 58 transmits/receives communication data to/from an external device. In addition, the droplet ejection type recording apparatus 10 is also provided with an operation display portion 60. While accepting an instruction given to the droplet ejection type recording apparatus 10 by a user, the operation display portion 60 displays various information about an operating status etc. of the droplet ejection type recording apparatus 10 to the user. Incidentally, the operation display portion 60 includes a display, and hardware keys such as numeric keys, a START button, etc. For example, the display is provided with a touch panel on a display surface where a display button and various information are displayed by execution of a program so that an operation instruction can be accepted on the touch panel. Incidentally, the operation display portion 60 is an example of a display unit according to the invention.

The CPU 50, the ROM 52, the RAM 54, the storage portion 56, the communication line I/FP portion 58, the operation display portion 60, the feeding motor 62, each head driving portion 22, and each drying device 26 are connected to one another through a bus 64 such as an address bus, a data bus, a control bus etc.

With the aforementioned configuration, access to the ROM 52, the RAM 54 and the storage portion 56 and transmission/reception of communication data to/from an external device through the communication line I/F portion 58 are performed respectively by the CPU 50 in the droplet ejection type recording apparatus 10 according to the exemplary embodiment. In addition, acquisition of various instruction information through the operation display portion 60 and display of various information on the operation display portion 60 are performed respectively by the CPU 50 in the droplet ejection type recording apparatus 10. In addition, control of the feeding motor 62, control of the head driving portion 22, and control of the drying device 26 are performed respectively by the CPU 50 in the droplet ejection type recording apparatus 10.

Normally, an image is formed by the droplet ejection type recording apparatus 10 at image formation speed which is set in advance by a user within a range (hereinafter referred to as "image quality guarantee range") in which predetermined image quality can be guaranteed. However, in design specifications of the apparatus, an image can be formed by the droplet ejection type recording apparatus 10 even at image formation speed exceeding an upper limit of the image quality guarantee range. Therefore, some user or some application etc. may have a request to form an image at such image formation speed.

Therefore, in the droplet ejection type recording apparatus 10 according to the exemplary embodiment, a special mode for forming an image at image formation speed higher (faster) than that in a normal mode can be set as another operating mode of the apparatus, in addition to the normal mode. The operating modes of the droplet ejection type recording apparatus 10 according to the exemplary embodiment will be described with reference to FIG. 4.

Figure 4:
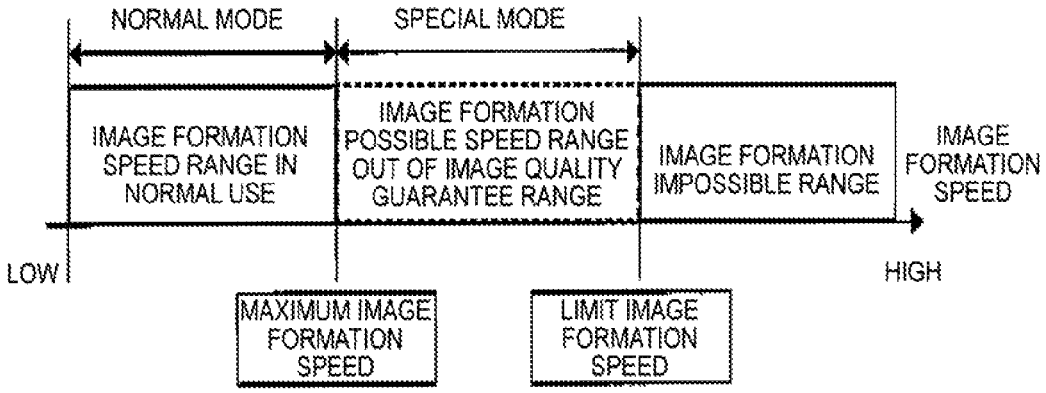
FIG. 4 is a schematic view provided for description about division of image formation speed in the droplet ejection type recording apparatus according to the exemplary embodiment.

As shown in FIG. 4, in the droplet ejection type recording apparatus 10 according to the exemplary embodiment, the image formation speed range is divided into three ranges, i.e. an image formation speed range (image quality guarantee range) in the normal mode, an image formation speed range in the special mode, and an image formation impossible range.

The normal mode according to the exemplary embodiment is an operating mode in which an image is formed within the image quality guarantee range. In addition, the special mode according to the exemplary embodiment is an operating mode in which an image is formed within a range higher than an upper limit value of a predetermined image formation speed range but lower than limit image formation speed. The predetermined image formation speed range is the image formation speed range in the normal mode. Here, the limit image formation speed is a limit value of image formation speed determined from driving limit values of constituent components etc. of the droplet ejection type recording apparatus 10 such as an upper limit value of feeding speed of the paper sheet P, a lower limit value of a driving interval of the head 24, etc. Accordingly, as shown in FIG. 4, the droplet ejection type recording apparatus 10 cannot form an image at image formation speed which is equal to or higher than the limit image formation speed.

Quality of an image formed in the special mode is often deteriorated in comparison with quality of an image formed in the normal mode. The deterioration of the image quality is mainly caused by deviation in landing position of each droplet (hereinafter referred to as "landing deviation") depending on fluctuation of droplet speed of each droplet commencing with a second droplet relative to droplet speed of a first droplet in the case where the droplets are ejected continuously (hereinafter referred to as "continuous ejection of droplets") in the feeding direction on the paper sheet P and continuously in different pixel positions. Incidentally, the droplet speed mentioned herein is expressed by a moving distance of a droplet in its ejection direction per unit time. In addition, the fluctuation of the droplet speed is generated due to the influence of refilling (droplet refilling) in the head 24 after droplet ejection or the influence of a residual pressure wave.

Figure 5:
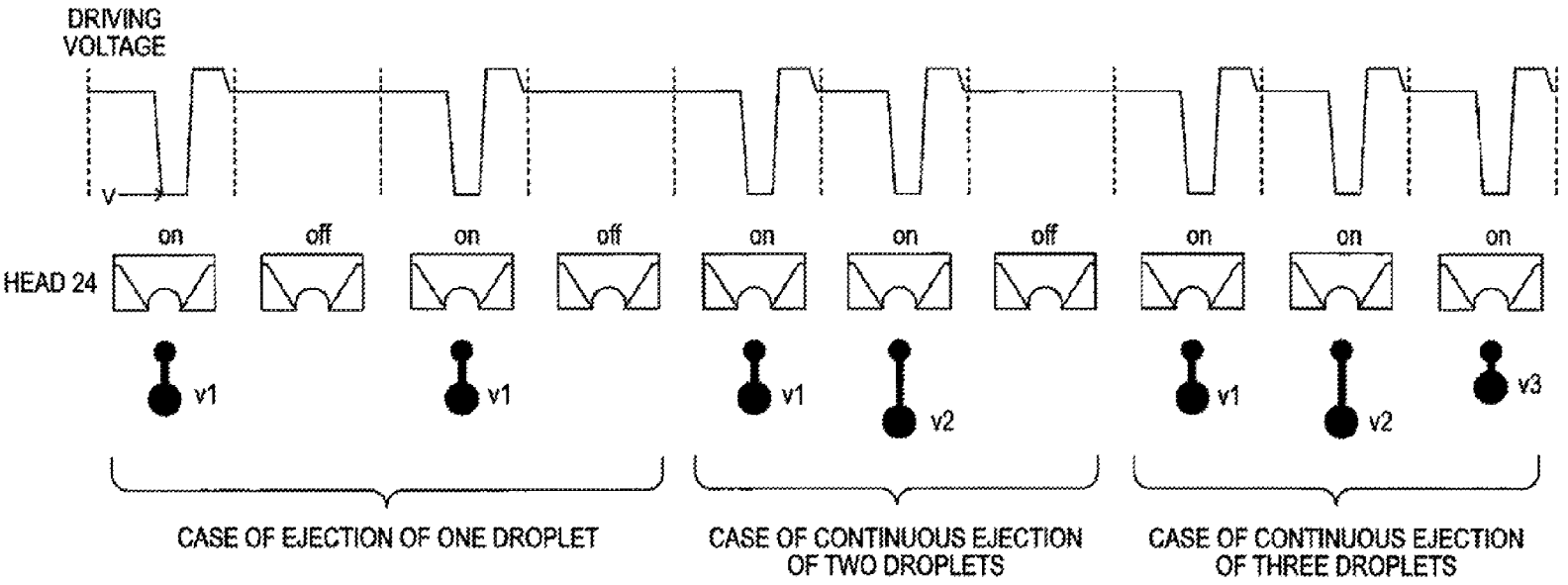
FIG. 5 is a driving waveform graph and a side sectional view of the droplet ejection member provided for description about droplet speed according to the exemplary embodiment.
Figure 6A:
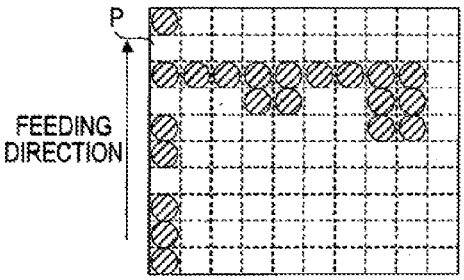
FIGS. 6A and 6B are schematic plan views provided for description about deterioration of image quality according to the exemplary embodiment.
Figure 6B:
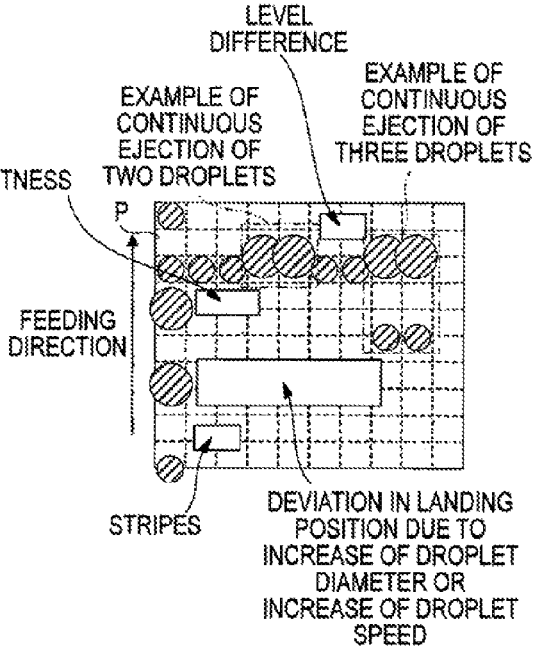

Deterioration of image quality caused by landing deviation will be described below with reference to FIG. 5 and FIGS. 6A and 6B. Incidentally, an upper row of FIG. 5 shows a waveform graph of driving voltage applied to the head 24. In addition, a middle row of FIG. 5 shows a driving state of the head 24 in the case where the corresponding driving voltage in the upper row is applied. A lower row of FIG. 5 shows droplet speed of droplets ejected from the head 24 in the case where the driving voltage in the upper row is applied. In the middle row of FIG. 5, a state in which a droplet is ejected is indicated as ON and a state in which a droplet is not ejected is indicated as OFF. In the lower row of FIG. 5, the droplet speed is indicated as a straight line which is longer in an up/down direction as the droplet speed is higher. FIG. 6A shows an image formed on a paper sheet P in the case where landing deviation has not occurred (droplets have been landed in ideal positions on the paper sheet P). FIG. 6B shows an image formed on a paper sheet P in the case where droplets have been ejected from the head 24 in the state shown in FIG. 5. Incidentally, broken lines in FIGS. 6A and 6B indicate pixels.

As shown in FIG. 5, in the exemplary embodiment, assume that droplets are ejected from the head 24 when voltage V [V] is applied to the head 24 as driving voltage of the head 24. In addition, Description will be made here on the assumption that the magnitude relation of $v_2>v_1>v_3$ is established among the droplet speeds by way of example, wherein droplet speed of a first droplet is expressed as $v_1$, droplet speed of a second droplet in continuous ejection of two droplets is expressed as $v_2$, and droplet speed of a third droplet in continuous ejection of three droplets is expressed as $v_3$.

When droplets are ejected from the head 24 in the state shown in FIG. 5, landing deviation occurs to thereby cause deterioration of image quality as shown in FIG. 6B, differently from the state shown in FIG. 6A. Specifically, in the case where two droplets are ejected continuously, the second droplet catches up with the first droplet and the second droplet is absorbed by the first droplet to thereby increase droplet speed of the droplet in comparison with ejection of only one droplet. As a result, a larger droplet than one droplet is landed in a front position in the feeding direction on the paper sheet P, in comparison with FIG. 6A. On the other hand, in the case where three droplets are ejected continuously, the first droplet and the second droplet are the same as those in the case where two droplets are ejected continuously, but the third droplet is landed in a rear position in the feeding direction on the paper sheet P, in comparison with the state shown in FIG. 6A.

When the droplets are ejected continuously in this manner, deterioration of the image quality caused by indistinctness, level difference, stripes, landing deviation, etc. of the image occurs due to fluctuation in the droplet speed of each droplet commencing with the second droplet relative to the droplet speed of the first droplet as shown in FIG. 6B by way of example. In addition, the deterioration degree of the image quality varies depending on a driving frequency (driving interval) of the need 24 determined based on the image formation speed.

Figure 7:
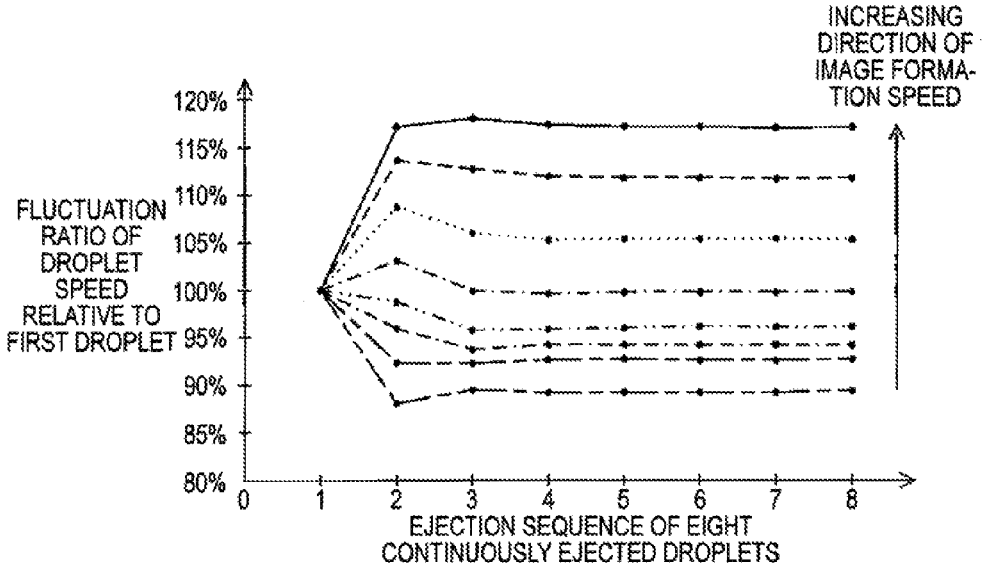
FIG. 7 is a graph showing an example of a fluctuation ratio of droplet speed according to the exemplary embodiment.
Figure 8:
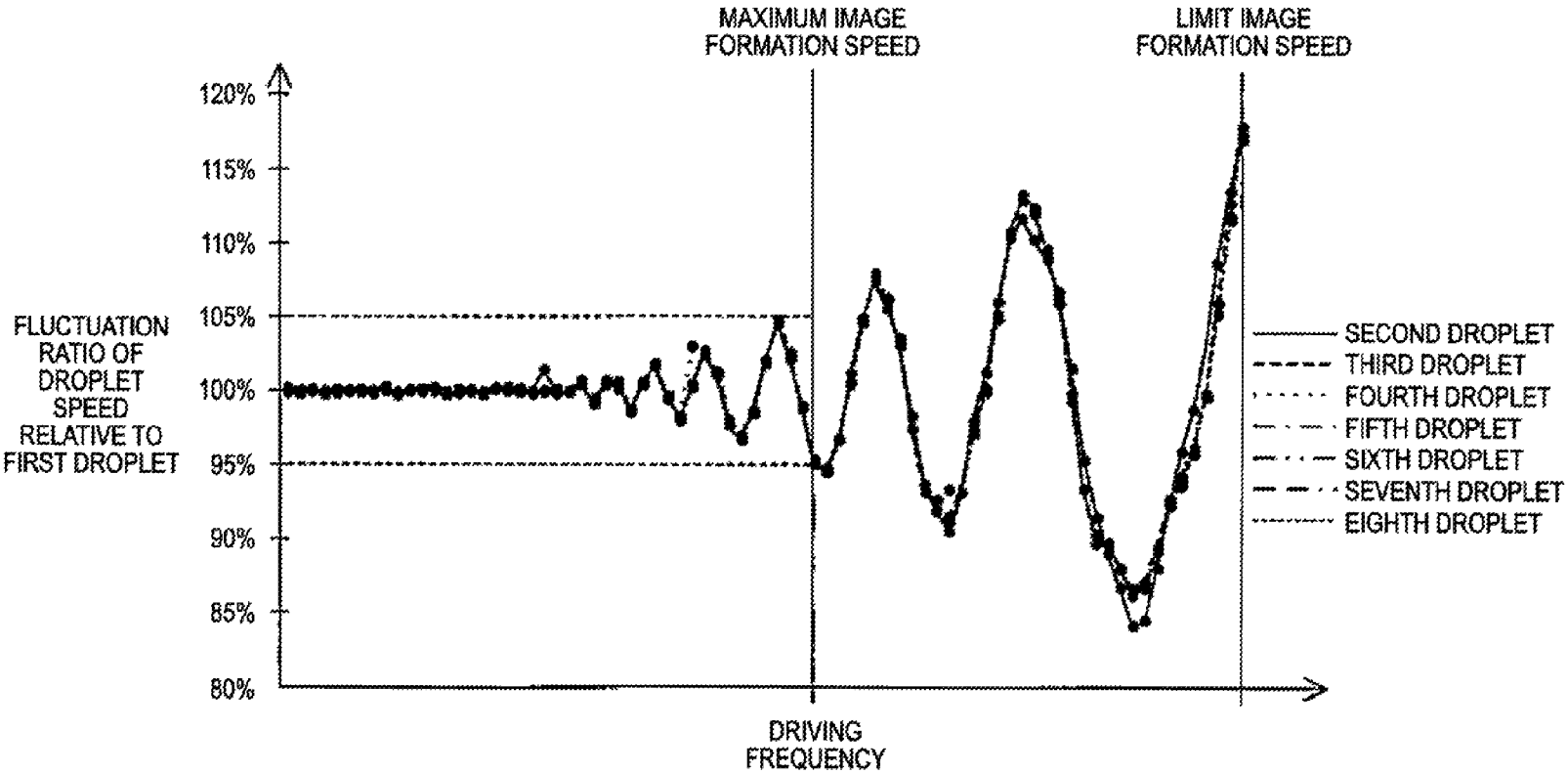
FIG. 8 is a graph showing an example of the fluctuation ratio of the droplet speed according to the exemplary embodiment.

A fluctuation ratio of droplet speed of each droplet commencing with the second droplet relative to droplet speed of a first droplet in continuous ejection of droplets will be described with reference to FIGS. 7 and 8. FIG. 7 shows a fluctuation ratio of droplet speed of each droplet commencing with the second droplet relative to droplet speed of a first droplet in continuous ejection of eight droplets at eight different kinds of image formation speed. In addition, the ordinate of FIG. 7 expresses the fluctuation ratio and the abscissa of FIG. 7 expresses the droplet number in the continuous ejection of the eight droplets. In addition, of eight lines in FIG. 7, a line closer to the upper of FIG. 7 corresponds to faster image formation speed. On the other hand, FIG. 8 shows the fluctuation ratio of the droplet speed of each droplet commencing with the second droplet in the continuous ejection of the eight droplets shown in FIG. 7, with the abscissa expressing the same fluctuation ratio as that in FIG. 7 and the abscissa expressing the driving frequency of the head 24. In addition, the exemplary embodiment will be described on the assumption that the case in which the fluctuation ratio of the droplet speed of each droplet commencing with the second droplet relative to the droplet speed of the first droplet is within a range of ±5% is set as an image quality guarantee range. Incidentally, the image quality guarantee range is not limited to a range in which the fluctuation ratio is within the range of ±5%. It is a matter of course that the image quality guarantee range may be set in accordance with requested image quality.

As shown in FIGS. 7 and 8, the fluctuation ratio of the droplet speed of each droplet commencing with the second droplet relative to the droplet speed of the first droplet in the continuous ejection of the droplets is relatively large. However, the fluctuation ratio of each droplet commencing with the third droplet relative to the droplet speed of the second droplet is much smaller than the fluctuation ratio of the droplet speed of the second droplet.

In addition, as shown in FIG. 8, when an image is formed by the head 24 which is driven in a driving frequency within a range corresponding to image formation speed within a range higher than maximum image formation speed but lower than the limit image formation speed, the fluctuation ratio of the droplet speed of the second droplet relative to the droplet speed of the first droplet varies even beyond ±5%. As a result, the image quality of the image formed on the paper sheet P is also deteriorated as shown in FIG. 6B by way of example. Accordingly, in the background art, the user repeats image formation while changing the image formation speed from one to another in the image formation in the special mode. In this manner, the user determines image formation speed with which the deterioration degree of the image quality can fall into a range desired by the user. Consequently, the user spends great time and labor to determine the image formation speed.

Figure 9:
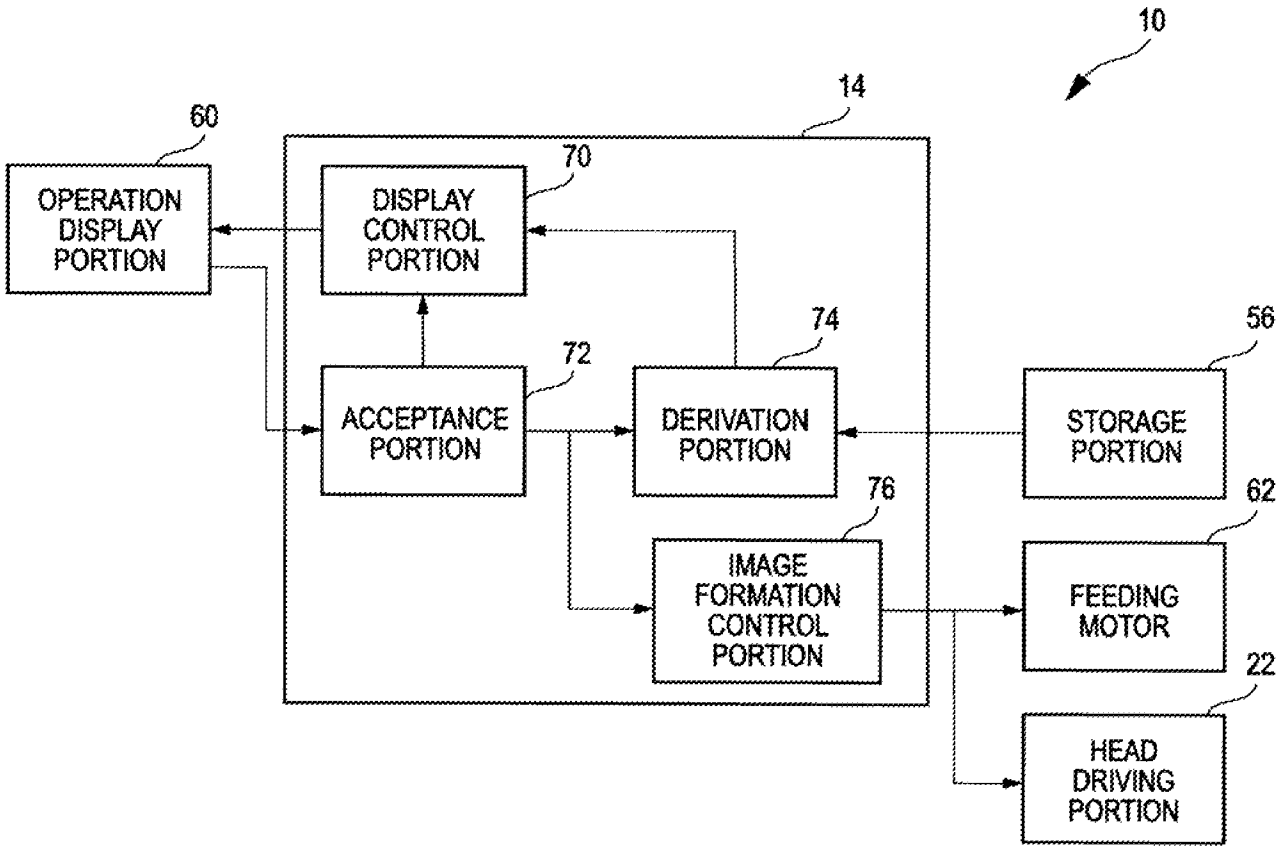
FIG. 9 is a functional block diagram showing the functional configuration of the droplet election type recording apparatus according to the exemplary embodiment.

To solve the problem, a special image formation function is installed in the droplet ejection type recording apparatus 10 according to the exemplary embodiment. The special image formation function is provided for forming an image within an image formation speed range in which the deterioration degree of image quality can fall into a range desired by the user when the operating mode is the special mode. Next, the special image formation function according to the exemplary embodiment will be described with reference to FIG. 9. Incidentally, a functional block diagram of the control portion 14 for executing the special image formation function according to the exemplary embodiment is shown in FIG. 9. The CPU 50 of the control portion 14 executes a special mode processing program which will be described later so that respective function portions shown in FIG. 9 can be realized. In addition, in the exemplary embodiment, for example, information (hereinafter referred to as "fluctuation ratio information") indicating the fluctuation ratio of the droplet speed of each droplet commencing with the second droplet relative to the droplet speed of the first droplet as shown in FIG. 8 is stored in the storage portion 56 in advance in order to realize the special image formation function. Incidentally, the storage medium for storing the fluctuation ratio information is not limited to the storage portion 56. It is a matter of course that, for example, the storage medium may be an external storage medium etc. which can be read by the droplet ejection type recording apparatus 10.

As shown in FIG. 9, the control portion 14 of the droplet ejection type recording apparatus 10 according to the exemplary embodiment is provided with a display control portion 70, an acceptance portion 72, a derivation portion 74, and an image formation control portion 76.

Figure 10:
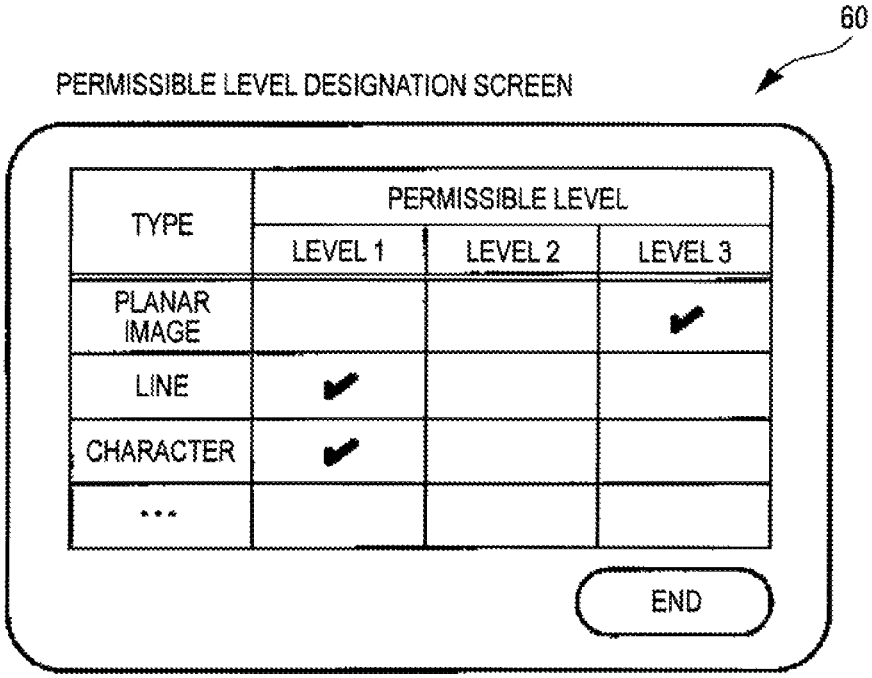
FIG. 10 is a schematic view showing an example of a permissible level designation screen according to the exemplary embodiment.

The display control portion 70 according to the exemplary embodiment displays a permissible level designation screen on the display of the operation display portion 60. In the permissible level designation screen, a user can designate a permissible level of the deterioration degree of image quality in an image to be formed by the droplet ejection type recording apparatus 10. An example of the permissible level designation screen is shown in FIG. 10. As shown in FIG. 10, the user designates a permissible level for each of image types such as planar image, line, character, etc. in the permissible level designation screen, and then designates an END button displayed in a lower portion of the permissible level designation screen. Incidentally, the case where Level 3 is designated for the planar image and Level 1 is designated for both the line and the character as the permissible level by the user is shown in FIG. 10. In the exemplary embodiment, the degree for permitting deterioration of the image quality is larger here as the level number is larger.

On the other hand, the acceptance portion 72 according to the exemplary embodiment accepts the permissible level of each of the image types designated in the permissible level designation screen, and outputs the accepted permissible level of the image type to the derivation portion 74.

Figure 11:
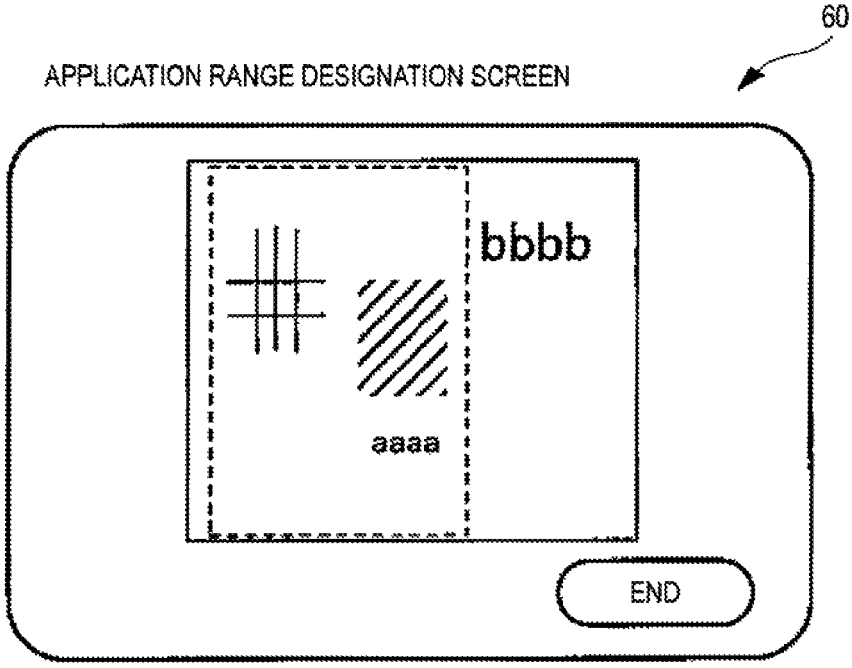
FIG. 11 is a schematic view showing an example of an application range designation screen according to the exemplary embodiment.

In addition, when the permissible level is accepted by the acceptance portion 72, the display control portion 70 displays an application range designation screen on the display of the operation display portion 60. In the application range designation screen, a range (hereinafter referred to as "application range") for applying image formation in the special mode in an image to be formed can be designated by the user. An example of the application range designation screen is shown in FIG. 11. As shown in FIG. 11, the user designates the application range (for example, a rectangular range surrounded by a broken line in FIG. 11) and then designates an END button displayed in a lower portion of the application range designation screen.

The acceptance portion 72 accepts the application range designated in the application range designation screen, and outputs the accepted application range to the image formation control portion 76.

The derivation portion 74 derives a range of the fluctuation ratio of the droplet speed of each droplet commencing with the second droplet relative to the droplet speed of the first droplet, as a range satisfying the image quality set in accordance with the permissible levels inputted from the acceptance portion 72. A process of deriving the range of the fluctuation ratio to be performed by the derivation portion 74 will be described below with reference to FIGS. 12 to 14.

Figures 12, 13:
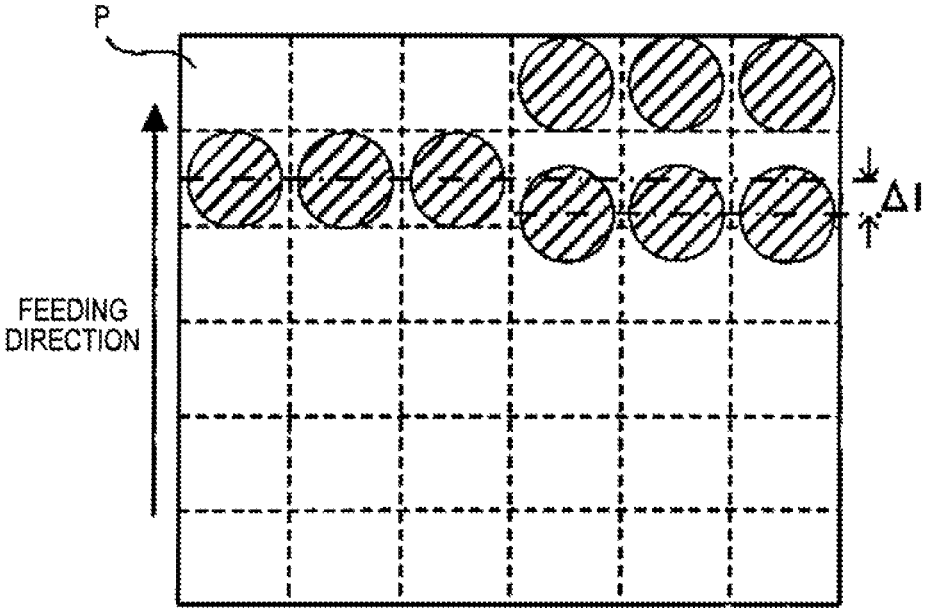
FIG. 12 is a schematic view provided for description about a process of deriving droplet speed of each droplet commencing with a second droplet in continuous ejection of droplets according to the exemplary embodiment.
FIG. 13 is a schematic plan view provided for description about a deviation amount according to the exemplary embodiment.

As shown in FIG. 12, droplet speed of a y-th droplet in continuous ejection of x droplets is hereinafter expressed as $v_{xy}$. Incidentally, ejection of a single droplet is expressed here as continuous ejection of one droplet for convenience's sake. In addition, as shown in FIG. 13, a deviation amount of a landing position of a droplet relative to an ideal landing position of the droplet in the feeding direction is expressed as Δ1. In addition, droplet speed $v_{11}$ is determined from image formation speed set by the user and resolution of an image to be formed in the feeding direction. In addition, in the exemplary embodiment, assume that droplet speed of each first droplet such as droplet speed $v_{21}$, $v_{31}$ . . . is equal to the droplet speed $v_{11}$ in order to avoid complication.

When a fluctuation ratio of droplet speed $v_{xy}$ of each droplet commencing with the second droplet relative to the droplet speed $v_{11}$ of the first droplet is expressed as $a_{xy}$, the droplet speed $v_{xy}$ of each droplet commencing with the second droplet in continuous ejection of droplets can be obtained by the following expression (1).

$$v_{xy}=a_{xy}v_{11} \tag{1}$$

In addition, when the image formation speed set by the user is expressed as $v_p$ and a distance between the head 24 and a paper sheet P is expressed as TD, the deviation amount Δ1 can be obtained by the following expression (2).

$$\Delta l=\left(\frac{TD}{v_{xy}}-\frac{TD}{v_{11}}\right)v_p=\frac{(1-a_{xy})TDv_p}{a_{xy}v_{11}} \tag{2}$$

When the aforementioned expression (2) is solved for the fluctuation ratio $a_{xy}$, the following expression (3) can be obtained.

$$a_{xy}=\frac{TDv_p}{\Delta l v_{11}+TDv_p} \tag{3}$$

The derivation portion 74 derives the fluctuation ratio $a_{xy}$ by use of the aforementioned expression (3). Here, the process of deriving the fluctuation ratio $a_{xy}$ to be performed by the derivation portion 74 will be described using specific numerical values by way of example.

First, assume that, for example, the image formation speed $v_p$ is 1.67 [m/s], the droplet speed $v_{11}$ is 7.0 [m/s], and the distance TD is 1 [mm]. In addition, assume that, for example, a lower limit value and an upper limit value of the deviation amount Δ1 are ±10.5 [μm] in the case where Level 1 is designated as the permissible level, ±15.25 [μm] in the case where Level 2 is designated as the permissible level, and ±21 [μm] in the case where Level 3 is designated as the permissible level.

The derivation portion 74 derives a lower limit value and an upper limit value of the fluctuation ratio $a_{xy}$ for each ox the permissible levels by use of the respective values of the aforementioned numerical value examples and the aforementioned expression (3). In the case of the aforementioned numerical value examples, 96% and 104% are derived as the lower limit value and the upper limit value of the fluctuation ratio $a_{xy}$ for Level 1, 96% and 106% are derived as the lower limit value and the upper limit value of the fluctuation ratio $a_{xy}$ for Level 2, and 92% and 108% are derived as the lower limit value and the upper limit value of the fluctuation ratio $a_{xy}$ for Level 3. In this manner, there may be a case where a narrower range than a range of from 95% to 105% which is the fluctuation ratio range in the normal mode is derived. This is because that landing deviation affected by the fluctuation ratio may occur more easily as the image formation speed is higher.

Based on the lower limit value and the upper limit value of the derived fluctuation ratio $a_{xy}$ and fluctuation ratio information (see FIG. 8) stored in advance in the storage portion 56, the derivation portion 74 derives a driving frequency range of the head 24 in which the fluctuation ratio expressed by the fluctuation ratio information can fall into the derived range of the fluctuation ratio $a_{xy}$.

Figure 14:
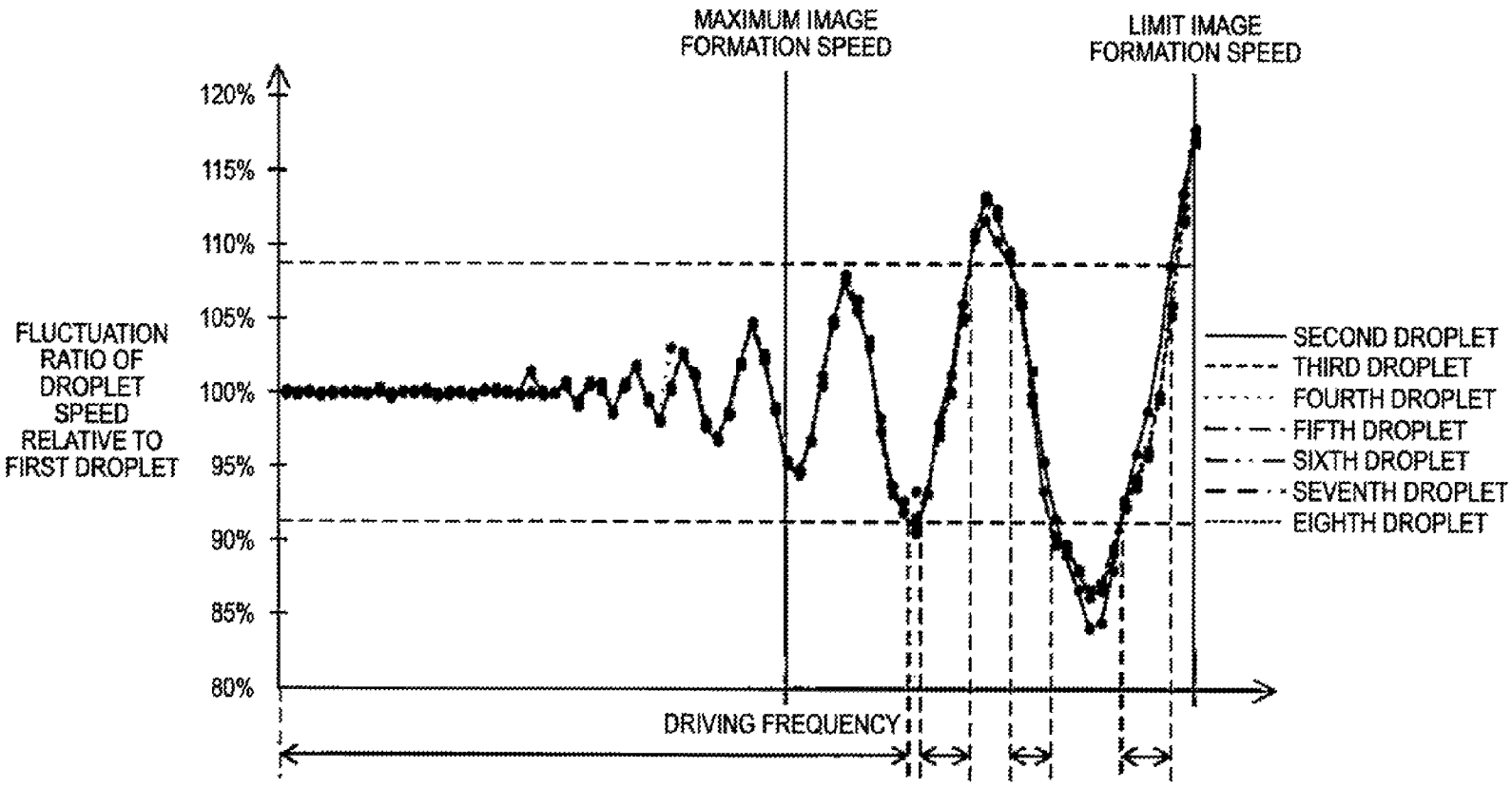
FIG. 14 is a graph provided for description about a process of deriving a driving frequency range in the head according to the exemplary embodiment.

When, for example, 92% and 108% are derived respectively as the lower limit value and the upper limit value of the fluctuation ratio $a_{xy}$, the derivation portion 74 derives a driving frequency range (range indicated by two arrows in a lowermost portion of FIG. 14) of the head 24, in which the fluctuation ratio of the droplet speed of each droplet commencing with the second droplet relative to the droplet speed of the first droplet can fall into the range not lower than 92% and not higher than 108%, as shown in FIG. 14.

Further, the derivation portion 74 outputs the derived driving frequency range of the head 24 to the display control portion 70. Incidentally, when different permissible levels are designated by the user, the derivation portion 74 may derive a driving frequency range of the head 24 corresponding to the highest level or may derive a driving frequency range of the head 24 corresponding to the lowest level. In addition, when the different permissible levels are designated by the user, the derivation portion 74 may derive a driving frequency range of the head 24 corresponding to a most frequently designated level.

Figure 15:
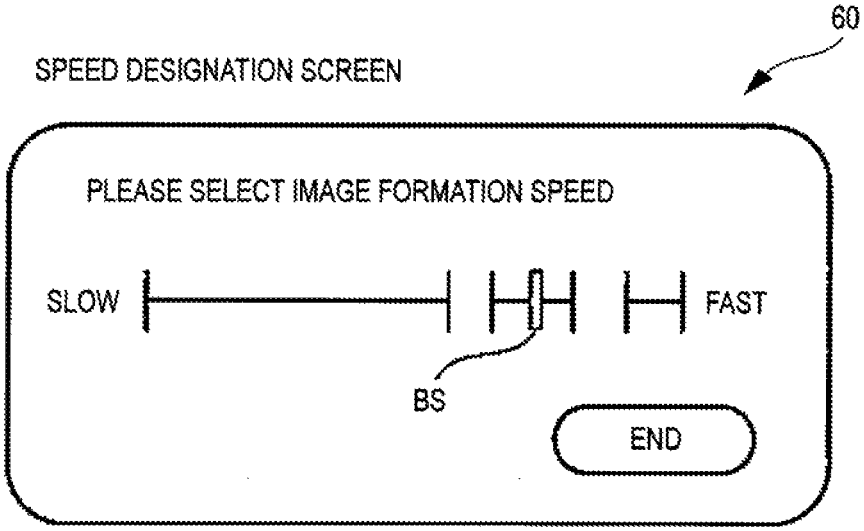
FIG. 15 is a schematic view showing an example of a speed designation screen according to the exemplary embodiment.

The display control portion 70 displays a speed designation screen on the display of the operation display portion 60. In the speed designation screen, the user designates image formation speed within an image formation speed range corresponding to the driving frequency range of the head 24 inputted from the derivation portion 74. An example of the speed designation screen is shown in FIG. 15. Incidentally, in the example shown in FIG. 15, a range of a straight line between "slow" and "fast" in a left/right direction is set as a speed range which can be designated by the user. As shown in FIG. 15, the user moves a slide bar SB in the left/right direction within the displayed range to designate desired image formation speed, and then designates an END button displayed in a lower portion of the speed designation screen.

Figure 16:
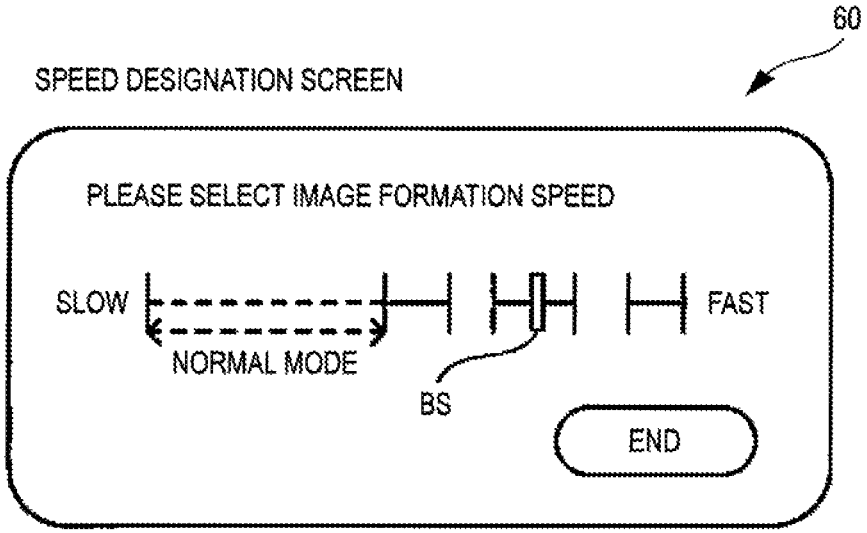
FIG. 16 is a schematic view showing an example of a speed designation screen according to a modification.

In this manner, the display control portion 70 according to the exemplary embodiment displays, as the speed designation screen, a screen in which an entire image formation speed range corresponding to the driving frequency range of the head 24 derived by the derivation portion 74 can be designated. However, the display control portion 70 is not limited thereto. For example, the display control portion 70 may display, as the speed designation screen, a screen in which a range not higher than maximum image formation speed is not allowed to be designated as shown in FIG. 16 by way of example. In addition, for example, the display control portion 70 may display only a range higher than the maximum image formation speed, as the speed designation screen.

The acceptance portion 72 accepts the image formation speed designated in the speed designation screen and outputs the accepted image formation speed to the image formation control portion 76. Incidentally, the acceptance portion 72 is an example of a first acceptance unit and a second acceptance unit according to the invention.

The image formation control portion 76 controls the head driving portion 22 and the feeding motor 62, etc. to form an image on a paper sheet P at image formation speed set in advance, as to, of the image to be formed, a portion out of the application range outputted by the acceptance portion 72.

On the other hand, the image formation control portion 76 controls the head driving portion 22 and the feeding motor 62, etc. to form an image on a paper sheet P at image formation speed accepted by the acceptance portion 72, as to, of the image to be formed, a portion within the application range outputted by the acceptance portion 72. Incidentally, the image formation control portion 76 is an example of a control unit according to the invention.

Figure 17:
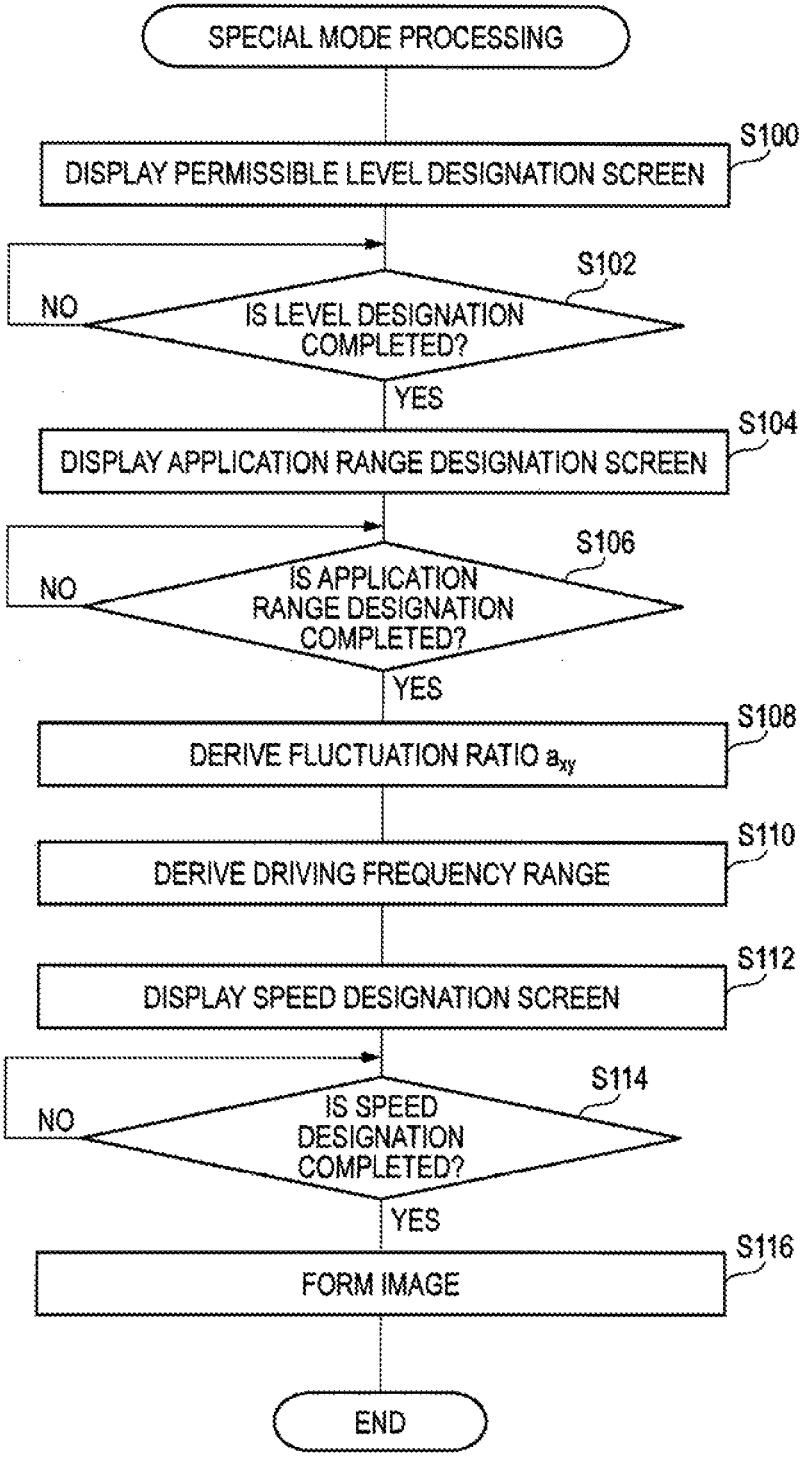
FIG. 17 is a flowchart showing the processing flow of a special mode processing program according to the exemplary embodiment.

Next, an effect of the droplet ejection type recording apparatus 10 according to the exemplary embodiment during execution of the special image formation function will be described with reference to FIG. 17. Incidentally, FIG. 17 is a flow chart showing the processing flow of the special mode processing program executed by the CPU 50 whenever an instruction to form an image on a paper sheet P is inputted in the state in which the special mode has been set as the operating mode. In addition, the special mode processing program is installed in the ROM 52 in advance. In addition, description will be made here on the assumption that image formation speed $v_p$ has been set in advance by a user in order to avoid complication.

In a step 100 of FIG. 17, the CPU 50 displays a permissible level designation screen (see FIG. 10) on the display of the operation display portion 60. In a next step 102, the CPU 50 stands by until each permissible level in the permissible level designation screen is designated.

When the permissible level designation screen is displayed on the display of the operation display portion 60, the user designates the permissible level for each image type through the touch panel of the operation display portion 60, and then designates an END button. In response to this, affirmative determination is obtained in the step 102. Then, the routine of the processing flow goes to a step 104.

In the step 104, the CPU 50 displays an application range designation screen (see FIG. 11) on the display of the operation display portion 60. In a next step 306, the CPU 50 stands by until an application screen in the application range designation screen is designated.

When the application range designation screen is displayed on the display of the operation display portion 60, the user designates an application range through the touch panel of the operation display portion 60, and then designates an END button. In response to this, affirmative determination is obtained in the step 106. Then, the routine of the processing flow goes to a step 108.

In the step 108, the CPU 50 derives a lower limit value and an upper limit value of a fluctuation ratio $a_{xy}$ by use of the aforementioned expression (3) and from image formation speed $v_p$, a deviation amount $\Delta 1$ corresponding to the permissible level accepted in the permissible level designation screen, droplet speed $v_{11}$ corresponding to the image formation speed $v_p$ and resolution of an image, and a distance TD, as described above.

In a next step 110, the CPU 50 derives a driving frequency range of the head 24 to be within a range of the fluctuation ratio $a_{xy}$ in which fluctuation ratios expressed by fluctuation ratio information (see FIG. 8) stored in advance in the storage portion 56 have been derived, based on the lower limit value and the upper limit value of the fluctuation ratio $a_{xy}$ derived in the step 108 and the fluctuation ration information, as described above.

In a next step 112, the CPU 50 displays, as a speed designation screen (see FIG. 15), an image formation speed range corresponding to the driving frequency range derived in the step 110 on the display of the operation display portion 60. In a next step 114, the CPU 50 stands by until image formation speed is designated in the speed designation screen.

When the speed designation screen is displayed on the display of the operation display portion 60, the user designates image formation speed through the touch panel of the operation display portion 60 and then designates an END button. In response to this, affirmative determination is obtained in the step 114. Then, the routine of the processing flow goes to a step 116.

In the step 116, the CPU 50 controls the head driving portion 22 and the feeding motor 62, etc. to form an image at the image formation speed accepted in the speed designation screen, as to, of an image expressed by image information, the range selected in the step 104. In addition, the CPU 50 controls the head driving portion 22 and the feeding motor 62 etc. to form an image at the image formation speed $v_p$, as to, of the image expressed by the image information, a range out of the range selected in the step 104. After executing the processing of the step 116, the CPU 50 terminates the special mode processing program.

Figure 18:
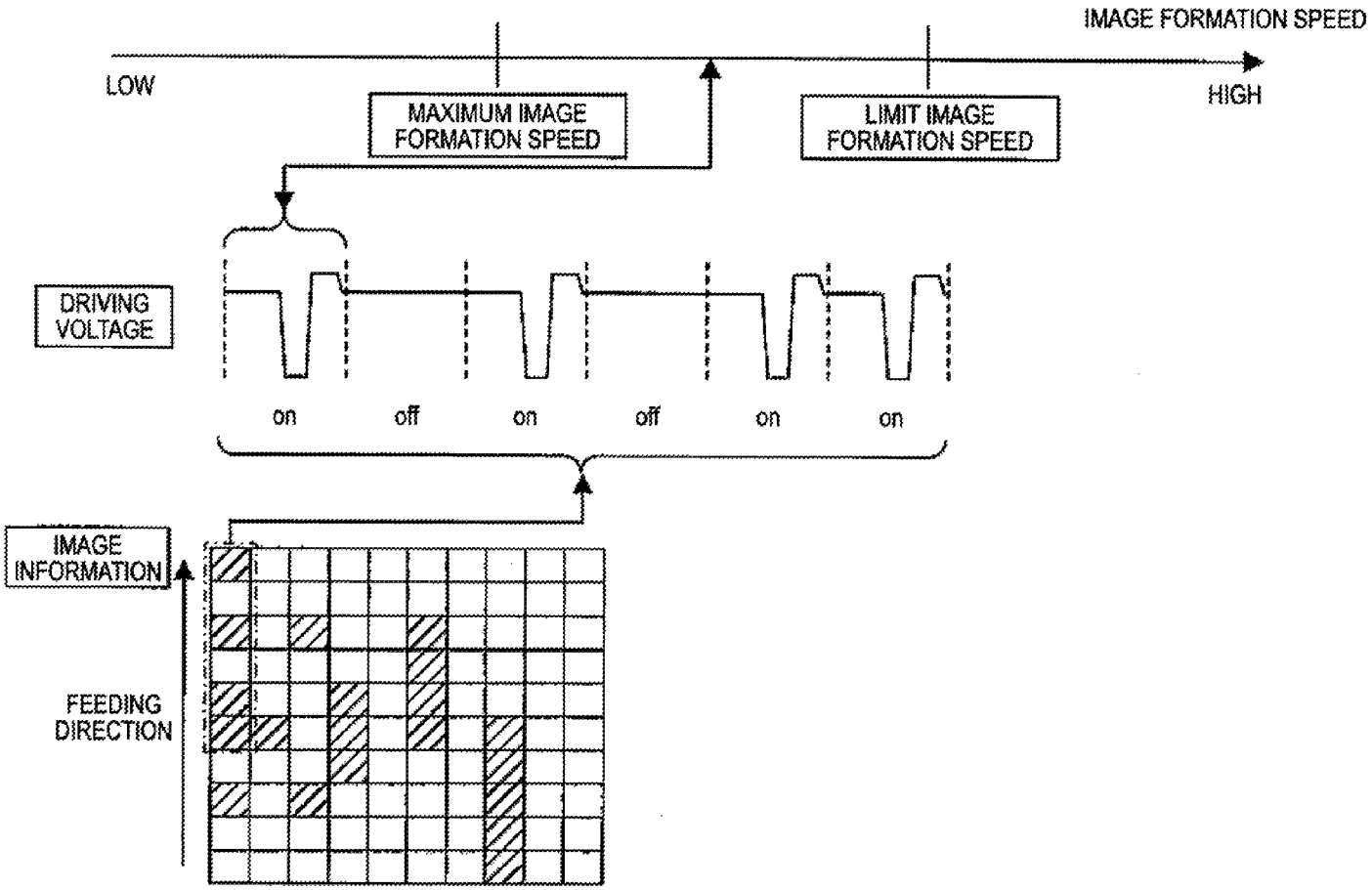
FIG. 18 is a schematic view provided for description about image formation processing in a special mode according to the exemplary embodiment.

By the aforementioned image formation processing in the special mode, an image can be formed on a paper sheet P at image formation speed within a range higher than maximum image formation speed but lower than limit image formation speed as shown in FIG. 18 by way of example. Incidentally, the image formation speed is shown in an upper row of FIG. 18, driving voltage of the head 24 and a driving state of the head 24 are shown in a middle row of FIG. 18, and image information expressing the image to be formed is shown in a lower row of FIG. 18. In addition, hatched portions of the image information in the lower row of FIG. 18 express pixels where the head 24 has to be driven.

Although the exemplary embodiment has been described above, the technical scope of the invention is not limited to the scope described in the aforementioned exemplary embodiment. It is possible to add various changes or improvements to the aforementioned exemplary embodiment without departing from the gist of the invention. Accordingly, modes having the added changes or improvements may be included in the technical scope of the invention.

In addition, the aforementioned exemplary embodiment is not intended to limit the invention according to Claims. Any combination of characteristics described in the exemplary embodiment is not always essential to the solution of the invention. Inventions in various stages may be included in the aforementioned exemplary embodiment. Various inventions may be extracted by combinations of disclosed constituent features. Even when some constituent features are deleted from the whole constituent features described in the exemplary embodiment, the configuration from which those constituent features have been deleted may be extracted as an invention as long as it can obtain an effect.

For example, the aforementioned exemplary embodiment has been described in the case where a speed designation screen is displayed and image formation speed is designated by a user. However, the invention is not limited thereto. For example, the invention may be carried out in a mode in which image formation speed is not designated by a user. A mode to form an image at highest speed within an image formation speed range derived by the derivation portion 74 is exemplified as the mode in this case. In addition, a mode to form an image at image formation speed in which a fluctuation amount of droplet speed of each droplet commencing with a second droplet relative to droplet speed of a first droplet is smallest (that is, the aforementioned fluctuation amount is closest to 100%) within an image formation speed range derived by the derivation portion 74 is also exemplified as the mode in this case.

In addition, the aforementioned exemplary embodiment has been described in the case where an application range designation screen is displayed and an application range in an image to be formed is designated by the user. However, the invention is not limited thereto. For example, the invention may be carried out in a mode in which the whole range of an image to be formed may be set as an application range in the image to be formed.

In addition, the aforementioned exemplary embodiment has been described in the case where three levels are used as the number of levels for the permissible level. However, the invention is not limited thereto. The invention may be carried out in a mode in which two levels are used as the number of levels for the permissive level or in a mode in which four levels or more are used as the number of levels for the permissive level. In addition, it will go well as long as the permissible level may be set at one of the levels in advance.

In addition, the aforementioned exemplary embodiment has been described in the case where the special mode processing program is installed in advance in the ROM 52. However, the invention is not limited thereto. For example, the invention may be carried out in a mode in which the special mode processing program is stored and provided in a storage medium such as a CD-ROM (Compact Disk Read Only Memory), or in a mode in which the special mode processing program is provided through a network.

Further, the aforementioned exemplary embodiment has been described in the case where the special mode processing is carried out by a software configuration using a computer to execute a program. However, the invention is not limited thereto. For example, the invention may be carried out in a mode in which the special mode processing is carried out by a hardware configuration or by combination of a hardware configuration and a software configuration.

In addition thereto, the configuration (see FIG. 1, FIGS. 2A and 2B, FIG. 3 and FIG. 9) of the droplet ejection type recording apparatus 10 described in the aforementioned exemplary embodiment is simply an example. It is a matter of course that any unnecessary part may be deleted or any new part may be added without departing from the gist of the invention.

In addition, the processing flow (see FIG. 17) of the special mode processing program described in the aforementioned exemplary embodiment is also simply an example. It is a matter of course that any unnecessary step may be deleted, any new step may be added or the processing sequence may be changed without departing from the gist of the invention.

Further, the configurations (see FIGS. 10, 11, 15 and 16) of the various screens shown in the aforementioned exemplary embodiment are also simply examples. It is a matter of course that partial information may be deleted from any screen, new information may be added to the screen or the display position of the screen may be changed without departing from the gist of the invention.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

a feeding unit that feeds a recording medium;

an ejection unit that ejects droplets onto the recording medium fed by the feeding unit;

a derivation unit that derives a fluctuation amount range of droplet speed of each droplet commencing with a second droplet relative to droplet speed of a first droplet as a range satisfying set image quality when continuous ejection of droplets are performed by the ejection unit so that the droplets are ejected continuously in different positions on the recording medium in a feeding direction of the recording medium within a range higher than an upper limit value of predetermined image formation speed but lower than limit image formation speed; and a control unit that performs control on the feeding unit and the ejection unit so as to form an image on the recording medium at image formation speed within a range determined in accordance with the range derived by the derivation unit.

2. The image forming apparatus according to claim 1, wherein the image quality is set in accordance with a permissible level of a deterioration degree of the image quality, the permissible level being accepted for each type of an image to be formed.

3. The image forming apparatus according to claim 2, further comprising:

a first acceptance unit that accepts, of an image to be formed, an application range to be controlled by the control unit; wherein:

the derivation unit derives the fluctuation amount range as to a portion within the application range of the image to be formed; and the control unit performs control on the feeding unit and the ejection unit so as to form an image on the recording medium at image formation speed within a range determined in accordance with the range derived by the derivation unit, as to the portion within the application range of the image to be formed.

4. The image forming apparatus according to claim 3, further comprising:

a display unit that displays an image formation speed range determined in accordance with the range derived by the derivation unit; and a second acceptance unit that accepts image formation speed designated within the range displayed by the display unit; wherein:

the control unit performs control on the feeding unit and the ejection unit so as to form an image on the recording medium at the image formation speed accepted by the second acceptance unit.

5. The image forming apparatus according to claim 3, wherein the control unit performs control on the feeding unit and the ejection unit so as to form an image on the recording medium at highest speed in image formation speed within a range determined in accordance with the range derived by the derivation unit.

6. The image forming apparatus according to claim 2, further comprising:

a display unit that displays an image formation speed range determined in accordance with the range derived by the derivation unit; and a second acceptance unit that accepts image formation speed designated within the range displayed by the display unit; wherein:

the control unit performs control on the feeding unit and the ejection unit so as to form an image on the recording medium at the image formation speed accepted by the second acceptance unit.

7. The image forming apparatus according to claim 2, wherein the control unit performs control on the feeding unit and the ejection unit so as to form an image on the recording medium at highest speed in image formation speed within a range determined in accordance with the range derived by the derivation unit.

8. The image forming apparatus according to claim 1, further comprising:

a first acceptance unit that accepts, of an image to be formed, an application range to be controlled by the control unit; wherein:

the derivation unit derives the fluctuation amount range as to a portion within the application range of the image to be formed; and the control unit performs control on the feeding unit and the ejection unit so as to form an image on the recording medium at image formation speed within a range determined in accordance with the range derived by the derivation unit, as to the portion within the application range of the image to be formed.

9. The image forming apparatus according to claim 8, further comprising:

a display unit that displays an image formation speed range determined in accordance with the range derived by the derivation unit; and a second acceptance unit that accepts image formation speed designated within the range displayed by the display unit; wherein:

the control unit performs control on the feeding unit and the ejection unit so as to form an image on the recording medium at the image formation speed accepted by the second acceptance unit.

10. The image forming apparatus according to claim 8, wherein the control unit performs control on the feeding unit and the ejection unit so as to form an image on the recording medium at highest speed in image formation speed within a range determined in accordance with the range derived by the derivation unit.

11. The image forming apparatus according to claim 1, further comprising:

a display unit that displays an image formation speed range determined in accordance with the range derived by the derivation unit; and a second acceptance unit that accepts image formation speed designated within the range displayed by the display unit; wherein:

the control unit performs control on the feeding unit and the ejection unit so as to form an image on the recording medium at the image formation speed accepted by the second acceptance unit.

12. The image forming apparatus according to claim 1, wherein the control unit performs control on the feeding unit and the ejection unit so as to form an image on the recording medium at highest speed in image formation speed within a range determined in accordance with the range derived by the derivation unit.

13. A computer readable medium storing a program causing a computer to function as the derivation unit and the control unit of the image forming apparatus according to claim 1.

14. An image forming method comprising:

feeding a recording medium;

ejecting droplets onto the recording medium fed;

deriving a fluctuation amount range of droplet speed of each droplet commencing with a second droplet relative to droplet speed of a first droplet as a range satisfying set image quality when continuous ejection of droplets are performed by the ejecting so that the droplets are ejected continuously in different positions on the recording medium in a feeding direction of the recording medium within a range higher than an upper limit value of predetermined image formation speed but lower than limit image formation speed; and performing control on the feeding and the ejecting so as to form an image on the recording medium at image formation speed within a range determined in accordance with the range derived.

* * * * *